US006699112B2

(12) United States Patent
Bergner et al.

(10) Patent No.: US 6,699,112 B2
(45) Date of Patent: Mar. 2, 2004

(54) ABRASIVE BODY AND ABRASIVE MEANS FOR AN ELECTRIC GRINDING TOOL, AND ELECTRIC GRINDING TOOL

(75) Inventors: Joao Bergner, Aidlingen (DE); Roland Senn, Oleyres (CH); Marco Brancato, Oberdorf (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/129,476

(22) PCT Filed: Aug. 9, 2001

(86) PCT No.: PCT/DE01/03054

§ 371 (c)(1),
(2), (4) Date: May 6, 2002

(87) PCT Pub. No.: WO02/24414

PCT Pub. Date: Mar. 8, 2002

(65) Prior Publication Data

US 2002/0155799 A1 Oct. 24, 2002

(51) Int. Cl.[7] ..... B24B 41/00; B23F 21/03

(52) U.S. Cl. ..... 451/357; 451/356; 451/548; 451/456

(58) Field of Search ..... 451/357, 344, 451/350, 358, 359, 351, 352, 353, 354, 356, 548, 541, 456

(56) References Cited

U.S. PATENT DOCUMENTS

| | | | | |
|---|---|---|---|---|
| 3,214,253 A | | 10/1965 | McCord | |
| 4,667,447 A | | 5/1987 | Barton | |
| 5,558,569 A | * | 9/1996 | Lee | 451/356 |
| 6,176,771 B1 | * | 1/2001 | Gaege | 451/490 |
| 6,179,696 B1 | * | 1/2001 | Duffy | 451/357 |
| 6,527,631 B2 | * | 3/2003 | Wuensch et al. | 451/357 |

FOREIGN PATENT DOCUMENTS

| | | | |
|---|---|---|---|
| DE | 195 30 542 A | 2/1997 | |
| DE | 299 12 511 U | 6/2000 | |
| DE | 299 12 511 U1 * | 6/2000 | B24D/11/02 |

* cited by examiner

*Primary Examiner*—Dung Van Nguyen
(74) *Attorney, Agent, or Firm*—Michael J. Striker

(57) ABSTRACT

In a grinding body (1) for an electric grinding tool, in particular a delta, eccentric or oscillation grinder, having a carrier plate (2), on which a granular abrasive (3) is disposed and which can be connected to a base plate of the grinding tool, a markedly higher material-removal capacity and a markedly longer service life are attained by providing that the carrier plate (2) comprises a steel band (12), in particular a stainless-steel spring band, and the granular abrasive (3) is a hard-metal granular abrasive (11).

13 Claims, 3 Drawing Sheets

Figure 1:
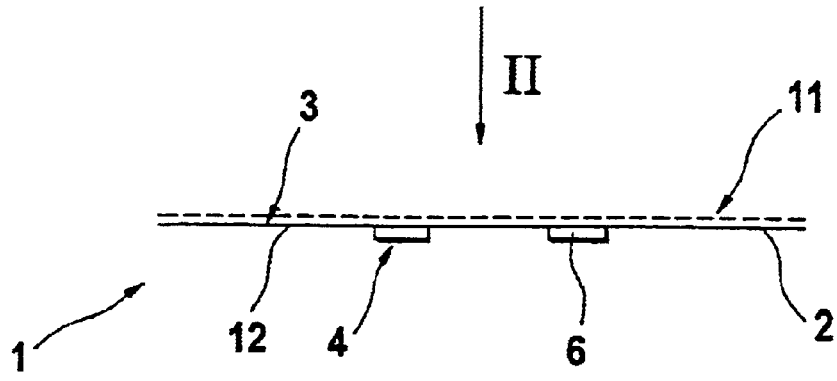

ABRASIVE BODY AND ABRASIVE MEANS FOR AN ELECTRIC GRINDING TOOL, AND ELECTRIC GRINDING TOOL

PRIOR ART

The invention is based on a grinding body for an electric grinding tool, having the generic characteristics of the preamble to claim 1; a grinding medium for an electric grinding tool, having the generic characteristics of the preamble to claim 6; and an electric grinding tool, having the generic characteristics of the preamble to claim 8.

For machining surfaces by grinding, delta, eccentric or oscillation grinders are for instance known. For machining the surface, they have a motor-driven grinding plate of polyurethane foam, on which a grinding body is mounted. The grinding body is sandpaper or grinding cloth to which granular abrasives are applied. The sandpaper or grinding cloth has a piece of velour on its side facing away from the granular abrasives, with which it is connected to the grinding plate via a barbed strip mounted there. However, only short service lives can be attained with the known grinding body, since when grinding hard surfaces, the granular abrasives wear down rapidly, and they quickly become clogged with paint when grinding painted surfaces. Such grinding bodies then have to be replaced. Moreover, the material-removal capacity is low, even when the grinding body is fresh, and so the same place has to be machined for a very long time until the desired grinding result is achieved.

ADVANTAGES OF THE INVENTION

A grinding body of the invention having the characteristics of claim 1, a grinding medium of the invention having the characteristics of claim 6, and an electric grinding tool of the invention having the characteristics of claim 8 have the advantage over the prior art of a long service life and high material-removing capacity.

In a grinding body of the invention, instead of sandpaper or grinding cloth, a steel band is used as the carrier plate, on which a granular abrasive comprising hard-metal granular abrasive is applied. Because a steel band is used as the carrier plate, the carrier plate does not become compressed and hence deformed like an accordion. Moreover, using a steel band makes it possible to use a hard-metal granular abrasive. This hard-metal granular abrasive is applied to the steel band using a special soldering process. However, since this soldering process is not definitive for the invention, it will not be explained in further detail in the present patent application. Using a hard-metal granular abrasive as the granular abrasive means that an extremely long service life is attained, since wear is hardly noticeable. Even when surfaces clogged with paint are ground, the grinding body does not have to be thrown away when it becomes clogged with paint; instead, the paint can simply be brushed out or knocked off. After that, the grinding body is again ready for use and is in practically the same state it was originally. Moreover, using hard-metal granular abrasive also makes for more-aggressive grinding, so that a high material-removal capacity is achieved.

Preventing compression of the steel band is preferably attained by providing that it has a tensile strength of more than 1100 $N/m^2$, in particular more than 1300 $N/m^2$, and preferably 2000 $N/m^2$. It is especially preferred if the steel band has a chromium content of between 14% and 20%, in particular 16.7%, and a nickel content of between 4% and 9%, in particular 6.64%.

The attempt is preferably made to embody the steel band as thinly as possible. The thinner it is, the lower its weight also is. An excessive thickness, at high rotary speeds, creates mechanical problems, such as imbalances. It is therefore advantageous if its thickness is less than 1 mm, in particular less than 0.3 mm, and preferably even only 0.2 mm. At a thickness of 0.3 mm, the grinding body has approximately the same weight as the conventional grinding bodies used until now, that were made of sandpaper with granular abrasives and a velour layer. The thinner the steel band is, the greater its tensile strength must be to prevent compression. At a tensile strength of 2000 $N/m^2$, it is accordingly also possible to use the especially preferred, quite thin steel band of only 0.2 mm in thickness. Conversely, that cannot be done if the tensile strength is only 1100 $N/m^2$.

Suction extraction of the grinding dust produced in grinding is possible by means of first suction-extraction holes embodied in the steel band. Hence the user of the electric grinding tool is not burdened by grinding dust, which is usually quite fine and by becoming deposited in the respiratory system is harmful to health.

In a grinding medium of the invention, a grinding body of the invention is glued, screwed, interlocked or directly sprayed onto the base plate directly in the form of foam. Gluing the steel band to the polyurethane base plate makes very simple and very inexpensive fastening of the two parts possible. Screwing the two parts together makes it possible, in the event of possible wear of the grinding body, which can never be precluded entirely, to replace only the grinding body without having to change the base plate as well. This reduces the costs to the user.

It is advantageous if the base plate has second suction-extraction holes, which are disposed under the first suction-extraction holes of the steel band. This assures optimal suction extraction of the grinding dust produced during operation. The result is the least possible burden on the user.

Further advantageous features of the invention are the subject of the dependent claims.

DRAWINGS

Three exemplary embodiments of the invention are explained in further detail in the ensuing description in conjunction with the associated drawing.

Figure 2:
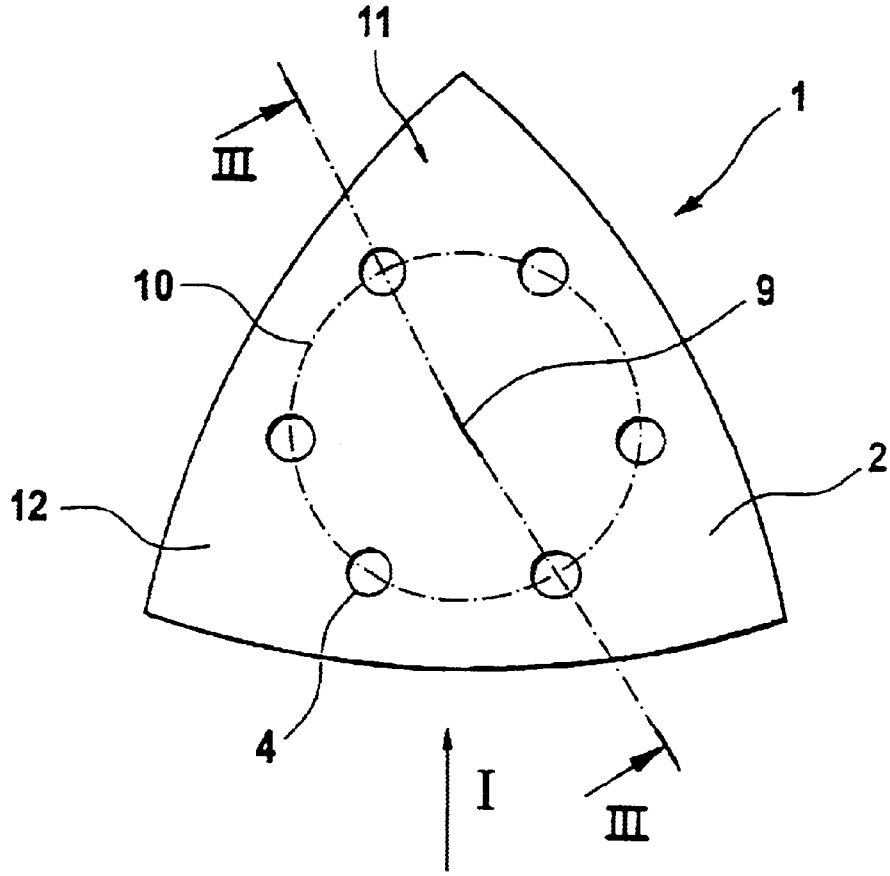
Figure 3:
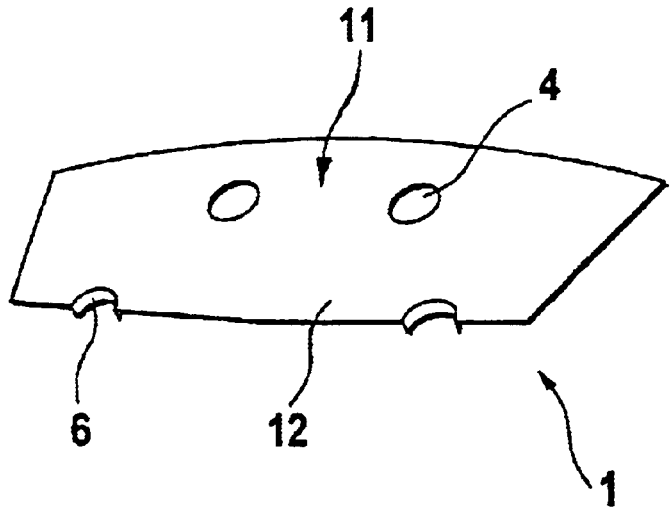
Figure 4:
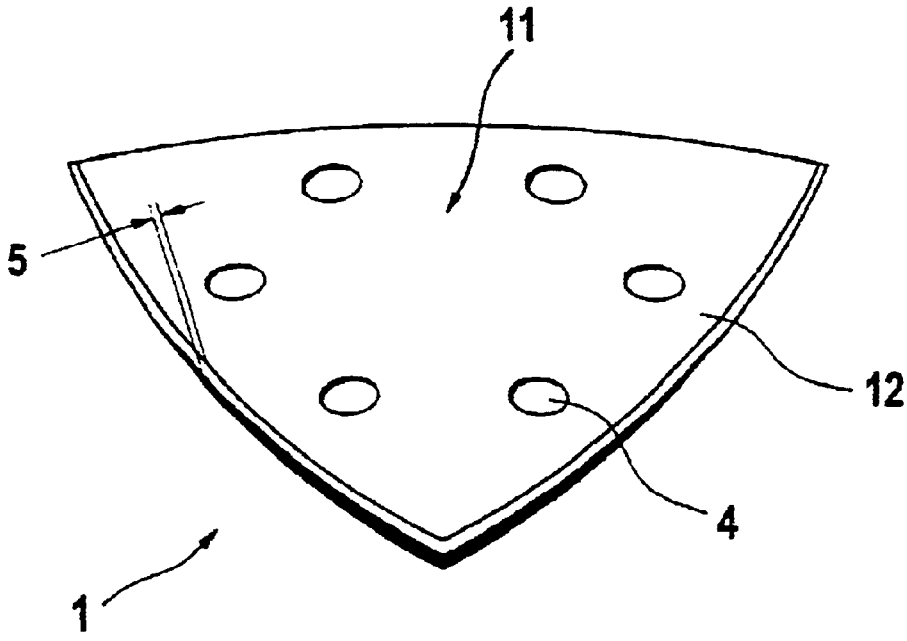
Figure 5:
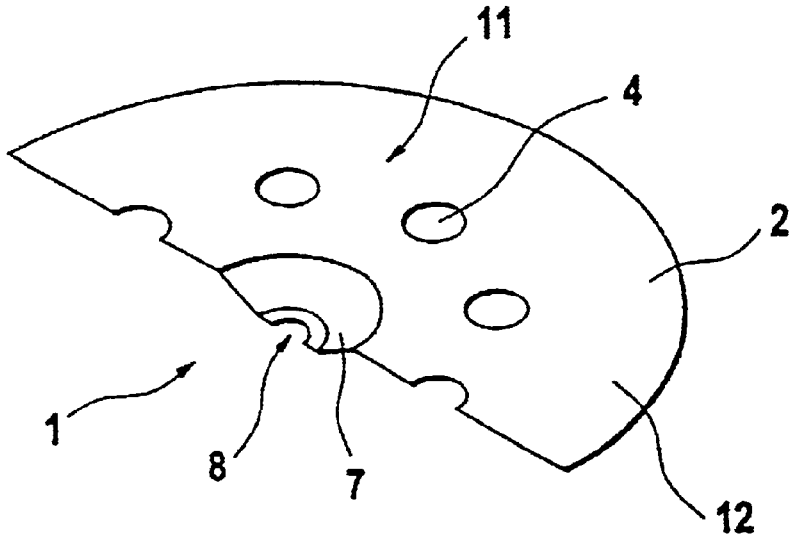
Figure 6:
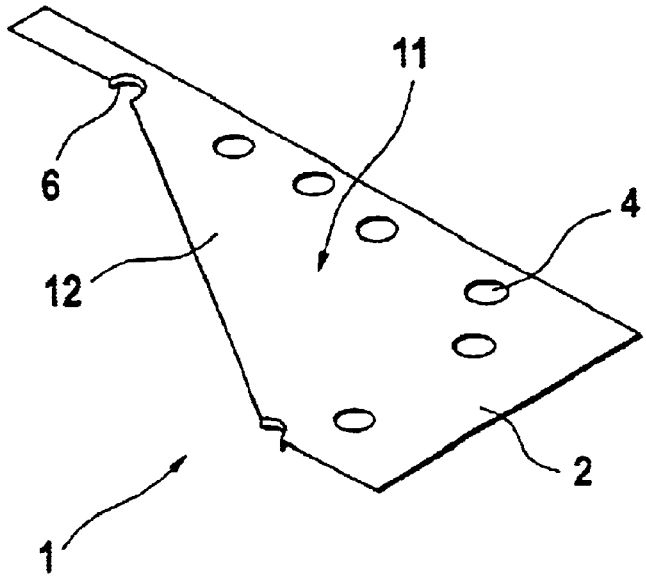

Shown are:

FIG. 1, a schematic side view of a grinding body of the invention for a delta grinder, seen from the direction marked I in FIG. 2;

FIG. 2, a plan view on the grinding medium, seen from the direction II in FIG. 1;

FIG. 3, a section through the grinding medium of FIG. 2, taken along the line A—A;

FIG. 4, a perspective view of the grinding medium of FIG. 2;

FIG. 5, a section through a grinding body of the invention for an eccentric grinder; and FIG. 6, a section through a grinding body of the invention for an oscillation grinder.

FIG. 1 shows a grinding body 1, which has a carrier plate 2 that comprises a steel band 12. The steel band 12 is embodied as a stainless-steel spring band. It has a chromium content of 16.7% and a nickel content of 6.64%. Its tensile strength is 1350 $N/m^2$. A layer of a granular abrasive 3 in the form of a hard-metal granular abrasive 11 is applied to the carrier plate 2. This is done by a specially controlled hard soldering process, which however is not relevant to the invention and is accordingly not described in detail here. The particle sizes of the hard-metal granular abrasives 11 are preferably those known for grinding media: coarse 30, medium 45, and fine 80. The carrier plate 2 has first suction-extraction holes 4, through which the grinding dust can be extracted by suction during a grinding operation, so that it does not threaten the health of the user. The first suction-extraction holes 4 are produced by a deep-drawing process. In this process they are embodied as conduits. The conduits have walls 6, which protrude past the surface of the carrier plate 2 on the side facing away from the granular abrasive 3.

The grinding body 1 for the delta grinder is glued to a base plate (not shown), which is driven by the electric tool and as a rule comprises polyurethane. With a suitable contact adhesive that connects metal to plastic, a temperature resistance of the adhesive layer up to 100° C. is attained. This is sufficient for secure fastening of the grinding body to the base plate.

In FIG. 2, the distribution of the first suction-extraction holes 4 in the carrier plate 2 can be seen. They are located along a circle 10 about the center point 9 of the carrier plate 2. The coating with hard-metal granular abrasive 3 is provided over the entire surface of the steel band 12, but it is understood that the first suction-extraction holes 4 are not also coated.

In FIG. 3, the first suction-extraction holes 4, embodied in the manner of conduits, can be seen in the steel band 12. The walls 6 of the deep-drawn first suction-extraction holes 4 are shown cut away. The coating with hard-metal granular abrasive 11 extends over the entire surface of the steel band 12. The walls of the first suction-extraction holes 4 are embodied such that they can engage second suction-extraction holes, not shown, in a base plate, also not shown, of the delta grinder. This serves as an adjustment aid, so that the first suction-extraction holes can be disposed directly above the second suction-extraction holes and as a result the best possible suction extraction of the grinding dust can be achieved.

In FIG. 4, the thickness 5 of the steel band 12 is shown. By using a stainless steel in the form of a spring steel band, it is possible to achieve a thickness 5 that is on the order of 0.3 mm. Even with such a thin steel band 12, compression during operation of the delta grinder is practically precluded because of the high tensile strength of the steel band 12. Because of the slight thickness 5, the grinding body 1 shown, even though it is of metal, has a weight that is approximately equal to that of a known grinding body made of sandpaper with granular abrasives and a velour layer. As a result, a delta grinder designed for a conventional grinding body can be used. If the grinding body of the invention were heavier, then at the extremely high motion speeds involved, mechanical problems would arise, for instance from imbalances, and these would rapidly lead to fatigue of the bearings in the delta grinder. Thus although because of its long service life the grinding body does not have to be replaced, nevertheless not replacing it would lead to premature wear of the delta grinder, which would then have to be refurbished. This is not wanted, however, since the delta grinder is much more expensive than the grinding body and should accordingly be protected as much as possible.

In FIG. 5, the grinding body 1 for an eccentric grinder is shown. In principle, the same description as for the grinding body 1 shown in FIGS. 1–4 applies here. For instance, the carrier plate 2 has a coating of hard-metal granular abrasive 11 on one face. First suction-extraction holes 4 are also embodied in the carrier plate 2. This grinding body 1 is also secured to a base plate (not shown). However, it is secured not as described in FIGS. 1–4, by gluing the grinding body 1 to the base plate, but by screwing the two parts together. To that end, an indentation 7 that has a hole 8 is made in the center of the grinding body 1. The indentation 7 can be made during the production of the grinding body 1, for instance by means of a deep-drawing process. Screwing the base plate and the grinding body 1 together is done by means of a screw that is passed through the hole 8 in the indentation of the grinding body 1 and engages a thread provided for that purpose on the base plate. In this way, the grinding body 1 can easily be removed from the base plate and, if it has any wear or damage, which can never be entirely precluded, it can easily be changed.

FIG. 5 shows a grinding body 1 for an oscillation grinder. What has been said of the two exemplary embodiments above applies in principle here as well. It differs from the grinding body 1 for the delta grinder essentially only in its external shape. Once again, first suction-extraction holes 4 are made by deep-drawing. Its surface is coated with a hard-metal granular abrasive 11. The grinding body 1 for the oscillation grinder is also glued to the polyurethane base plate (not shown).

What is claimed is:

1. A grinding body (1) for an electric grinding tool having a carrier plate (2), on which a granular abrasive (3) Is disposed and which can be connected to a base plate of the grinding tool, characterized in that the carrier plate (2) comprises a steel band (12) and the granular abrasive (3) is a hard-metal granular abrasive (11), wherein the carrier late 2 has suction-extraction holes 4 having walls (6), wherein said walls (6) protrude past a surface of the carrier plate (2) on a side facing away from the granular abrasive (3).

2. The grinding body (1) of claim 1, wherein the steel band (12) has a tensile strength of more than 1100 $N/m^2$.

3. The grinding body (1) of claim 2, wherein the steel band (12) has a tensile strength of more than 1300 $N/m^2$.

4. The grinding body (1) of claim 2, wherein the steel band (12) has a tensile strength of 2000 $N/m^2$.

5. The grinding body (1) of claim 1, wherein the steel band (12) has a chromium content of between 14% and 20% and a nickel content of between 4% and 9%.

6. The grinding body (1) of claim 5, wherein the steel band (12) has a chromium content of 16.7% and a nickel content of 6.64%.

7. The grinding body (1) of claim 1, wherein the steel band (12) has a thickness of less than 1 mm.

8. The grinding body (1) of claim 7, wherein the steel band (12) has a thickness of less than 0.3 mm.

9. The grinding body (1) of claim 7, wherein the steel band (12) has a thickness of 0.2 mm.

10. The grinding body (1) of claim 1, wherein first suction-extraction holes (4) are embodied in the steel band (12).

11. A grinding medium for an electric grinding tool having a grinding body (1), which is secured to a base plate, in particular of polyurethane, that can be connected to the drive mechanism of the electric tool, characterized in that the grinding body (1) is embodied in accordance with claim 1 and is glued, screwed, Interlocked, or sprayed directly onto the base plate in the form of foam.

12. The grinding medium of claim 11, wherein the bas plate has second suction-extraction holes, which are disposed under the first suction-extraction holes (4) of the steel band (12).

13. An electric grinding tool having a grinding medium, characterized in that the grinding medium is embodied in accordance with claim 11.

* * * * *